US009318843B2

(12) United States Patent
Dovranic

(10) Patent No.: US 9,318,843 B2
(45) Date of Patent: Apr. 19, 2016

(54) ROTATABLE RF CONNECTOR WITH COUPLING NUT

(71) Applicant: SPINNER GmbH, München (DE)

(72) Inventor: Zlatko Dovranic, München (DE)

(73) Assignee: SPINNER GMBH, Munich (DE)

( * ) Notice: Subject to any disclaimer, the term of this patent is extended or adjusted under 35 U.S.C. 154(b) by 24 days.

(21) Appl. No.: 14/331,615

(22) Filed: Jul. 15, 2014

(65) Prior Publication Data

US 2015/0024618 A1 Jan. 22, 2015

(30) Foreign Application Priority Data

Jul. 18, 2013 (EP) ..... 13177114

(51) Int. Cl.

| | |
|---|---|
| ***H01R 13/62*** | (2006.01) |
| ***H01R 4/38*** | (2006.01) |
| ***H01R 13/622*** | (2006.01) |
| ***H01R 24/40*** | (2011.01) |
| ***H01R 13/508*** | (2006.01) |
| ***H01R 13/627*** | (2006.01) |

(52) U.S. Cl.

CPC ..... *H01R 13/622* (2013.01); *H01R 13/508* (2013.01); *H01R 13/6277* (2013.01); *H01R 24/40* (2013.01)

(58) Field of Classification Search

CPC ..... H01R 13/622; H01R 13/6277; H01R 13/508; H01R 24/40

USPC ..... 439/321, 580, 578, 320, 579

See application file for complete search history.

(56) References Cited

U.S. PATENT DOCUMENTS

| | | | | |
|---|---|---|---|---|
| 6,358,077 | B1 | 3/2002 | Young | |
| 6,464,527 | B2 * | 10/2002 | Volpe et al. | 439/352 |
| 7,077,700 | B2 | 7/2006 | Henningsen | |
| 8,235,741 | B2 | 8/2012 | Schulze et al. | |
| 8,408,938 | B2 | 4/2013 | Proeckl | |
| 2007/0145744 | A1 | 6/2007 | Mehnert et al. | |
| 2008/0302565 | A1 | 12/2008 | Gaidosch | |

FOREIGN PATENT DOCUMENTS

| | | |
|---|---|---|
| CN | 101 807 765 | 8/2010 |
| DE | 103 53 886 | 2/2005 |

* cited by examiner

*Primary Examiner* — Javaid Nasri

(74) *Attorney, Agent, or Firm* — Norton Rose Fulbright US LLP

(57) ABSTRACT

An RF connector comprises a coupling nut for locking the connector to a mating connector and a locking ring. When tightening the coupling nut, it pushes on the locking ring, which again pushes on a protrusion of the connector, moving the connector into a mating connector. When the coupling nut is tightened, the locking ring acts as a stop to limit the movement coupling nut leaving a gap between the connector and the mating connector. Due to this gap, the connector may be rotated in a locked state.

9 Claims, 3 Drawing Sheets

ROTATABLE RF CONNECTOR WITH COUPLING NUT

PRIORITY CLAIM

This application claims priority to pending European patent application EP 13177114.9 filed Jul. 18, 2013, which is incorporated by reference in its entirety.

BACKGROUND OF THE INVENTION

1. Field of the Invention

The invention relates to a coaxial plug-and-socket connector for radio frequency (RF) electrical signals, comprising a plug part and a socket part and further comprising a coupling nut for fixing the parts together.

2. Description of Relevant Art

To achieve a secure and reliable connection between the parts of coaxial connectors, coupling nuts are frequently used. Such a coupling nut is disclosed in U.S. Pat. No. 8,235,741 B2. The nut has an inner thread interfacing with an outer thread of the other connector part. Preferably, the nut is tightened by manually or by using a torque wrench to avoid excessive torque, and therefore excessive force to the connector and its contact system. If the nut is tightened with excessive torque, it may even be damaged.

An electric plug-in connector with a coupling nut is disclosed in U.S. Pat. No. 8,408,938 B2. The coupling nut is rotatable against the outer conductor of the plug connector. It has an inner thread interfacing with an outer thread of a socket part. To avoid tightening with an excessive torque, even without a torque wrench, a component is provided which is shorn off in the case of excessive torque. The disadvantage is that the connection can no more be reopened and reused.

US 2007/0145744 discloses a multi-pole connector which uses a stop ring between a union nut and a mating connector to prevent damage of a sealing element.

When tightening a coupling nut of an RF connector, there may be significant internal friction in the connector, which also causes the attached cable to rotate or at least may prevent a later rotation of the cable, if necessary. This may impose a significant mechanical tension on the cable.

SUMMARY OF THE INVENTION

The embodiments are based on the object of providing a coaxial connector with a coupling nut, which allows a connected cable to rotate slightly, even if the coupling nut is tightened with a high torque, and which can easily be assembled and can be manufactured at comparatively low manufacturing costs.

Solutions of the problem are described in the independent claims. The dependent claims relate to further improvements of the invention.

In a first embodiment, an electrical connector, preferably a coaxial RF connector comprises a coupling nut. The electrical connector may be either a plug connector, a socket connector, or a hermaphroditic connector, although a plug connector is preferred. The connector preferably has a center axis which is defined by a center conductor of a coaxial system. The electrical connector may be connected to a mating connector. Such a mating connector may be a socket connector, a plug connector or a hermaphroditic connector; although a socket connector is preferred. The coupling nut has an inner thread, which interfaces, with an outer thread at the mating connector. It is preferred, if a plug connector has a coupling nut with an inner thread interfacing with an outer thread of a socket connector. The connector is locked to a mating connector by the coupling nut which holds the connector and the mating connector in close proximity. By rotating the locking nut, the connector may be pressed against the mating connector in a direction parallel to the center axis, further referred to an axial direction.

As shown in the prior art, a protrusion at the coupling nut directly interfaces with a corresponding protrusion at the outer conductor or a part of the housing of the connector. This causes a direct coupling of force from the coupling nut into the connector.

To allow at least a minor rotation around the center axis or even a full rotation of the connector and therefore of a cable attached to the connector, the mating connector may not be pressed hardly against the connector by the coupling nut, so that friction between these parts does not prevent rotation. It is preferred, if there is a minor gap in axial direction between the connector and the mating connector which allows rotation. Preferably, there is no seal in axial direction between the connector and a mating connector, as this would introduce an additional unwanted friction. Preferably, there is only a radial seal pressing in radial direction between the connector and a mating connector. Whereas an axial seal may easily slide off the connector and may get lost, a radial oriented seal may be held within a groove and cannot get lost. Furthermore, the grove provides a precise guidance of the seal.

According to the preferred embodiment, a locking ring 130 is provided between the coupling nut 120 and the connector 110. The locking ring is a separate part and preferably is made of metal, although it may also be made of a plastic or similar material. Preferably, it has a Z-shaped cross section. It has a cylindrical body with an inner protrusion at the inner side of the cylinder and an outer protrusion at the outer side of the cylinder. The inner protrusion is forming a first locking ring contact surface 131 which may interface with a first protrusion contact surface 113 formed by a protrusion 116 at the connector 110, preferably at the outer conductor of a coaxial connector. The outer protrusion is forming a second locking ring contact surface 132, which may interface with a coupling nut contact surface 121 of the coupling nut. Preferably, the first locking ring contact surface 131 and the second locking ring contact surface 132 face radially into opposite directions. Finally, the locking ring has a third locking ring contact surface 133, which may interface with the mating connector at a first mating connector contact surface 211. Preferably, the first locking ring contact surface 131 and the third locking ring contact surface 133 are oriented axially into the same direction. For interfacing with the locking ring 130, the connector has a protrusion 116, which has a first protrusion contact surface 113, and in axial direction on the opposite side of the protrusion 116 a second protrusion contact surface 117, which may contact the mating connector 200 at a second mating connector contact surface 212. This limits the movement of the connector between the locking ring and the mating connector. The distance between the first locking ring contact surface 131 and the second mating connector contact surface 212 is larger than the width of the protrusion 116 of the connector. The first mating connector contact surface 211 may be the same as the second mating connector contact surface 211. Preferably, the distance between the first locking ring contact surface 131 and the third locking ring contact surface 133 is larger than the protrusion of the connector. If the outer protrusion of the locking ring is close to the third locking ring contact surface 133, then the length of the locking nut can be reduced over a locking nut interfacing with the first protrusion contact surface 113 of the connector. Therefore, the connector can be built smaller.

The function is as follows: When the coupling nut 120 is tightened, the coupling nut contact surface 121 is moved towards the mating connector 200. As it stays in contact with the second locking ring contact surface 132, it moves the locking ring into the same direction. This further causes the connector 100 to move, because the first locking ring contact surface 131 interfaces with the first protrusion contact surface 113 of the protrusion 116. When the coupling nut 120 is tightened, its movement is stopped, as the coupling nut contact surface 121, which is in contact with the second locking ring contact surface 132 of the locking ring 130, presses the locking ring 130 with its third locking ring contact surface 133 against the first mating connector contact surface 211. As the coupling nut cannot further move into the direction of the mating connector, it can no more be rotated, and the connector is locked. Because, as described before, the distance of the first locking ring contact surface 131 to the second mating connector contact surface 212 is larger than the width 114 of the protrusion 116, the protrusion and therefore the connector 100 is not rigidly pressed against the mating connector. Therefore it may rotate at least slightly. To allow rotation, it is preferred, if there is at least small gap between the components of the connector and the mating connector, when the coupling nut is tightened.

Summarizing, the coupling nut is not coupled directly to the connector. Instead it is coupled by means of the locking ring, which holds the connector against the mating connector allowing some movement of the connector against the mating connector.

It may be sufficient to make the difference of distances which results in a gap between the connector and the mating connector, significantly lower than 1 mm, preferably less than 0.1 mm, and most preferably less than 0.01 mm.

To simplify assembly of the connector, it is preferred if the locking ring 130 has a groove or gap 112 which allows compression of the locking ring, reducing its diameter and easy insertion into the coupling nut 120. In a first assembly step, the locking ring 130 is pushed over the protrusion 116 of the connector 100 into a groove 112 and is compressed so that its outer diameter is less than the inner diameter of the coupling nut. Then, the coupling nut 120 may be slid over the connector and over the locking ring. The locking ring may also be automatically compressed by sliding the coupling nut over a ramp-shaped surface of the locking ring. When the coupling nut is in its final position with respect to the locking ring, the locking ring may be released or it extends by its spring force to fit into the coupling nut. If there is a circular groove in the nut, the groove comprising the coupling nut contact surface 121, then the sidewalls may hold the outer protrusion of the locking ring and therefore hold the locking ring at the nut. This prevents loosing of the locking ring, when the connector is open.

A further embodiment comprises a RF connector pair comprising a RF connector (100) and a mating connector (200). Both connectors are designed to fit to each other.

BRIEF DESCRIPTION OF THE DRAWINGS

In the following, the invention will be described by way of example, without limitation of the general inventive concept, on examples of embodiment and with reference to the drawings.

Figure 1:
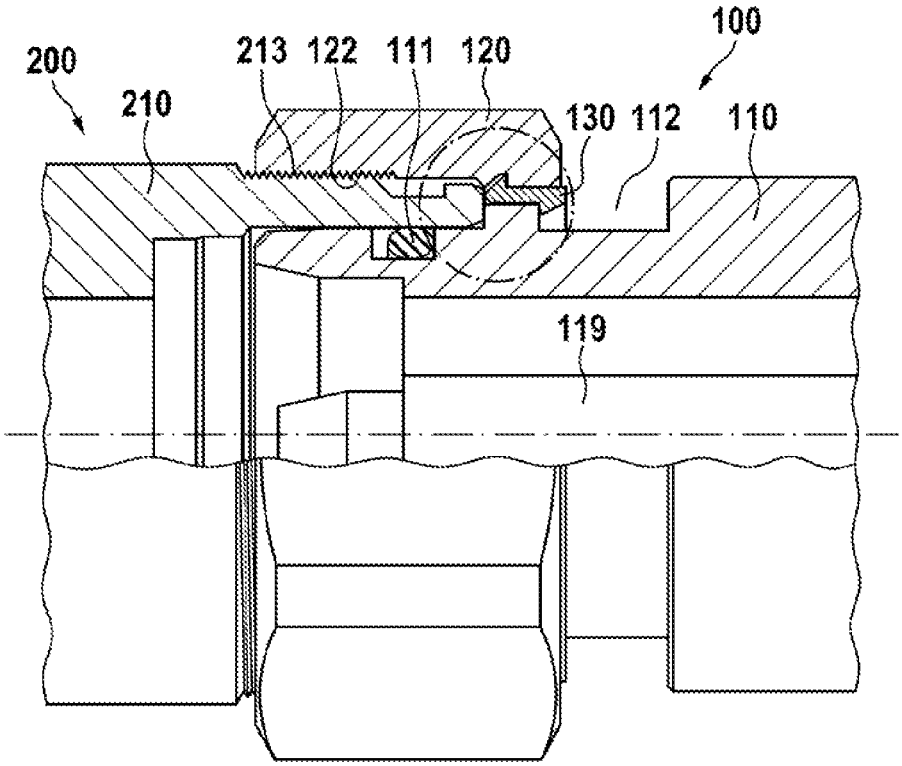
FIG. 1 shows a connector according to a first embodiment.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION OF THE PREFERRED EMBODIMENTS

FIG. 1 shows a connector 100 according to a first embodiment, mated with a mating connector 200. In this embodiment, the connector 100 is a male connector, also called plug connector. It is understood, that this connector may also be a female connector, also called socket connector, or a hermaphroditic connector. The connector 100 has an outer conductor 110 and an inner center conductor 119. It is shown mated with a mating connector 200, which is a female connector in this example. It has a mating connector outer conductor 210. The inner conductor is not shown herein. There may be a seal 111 as a seal ring between the male connector 100 and the female connector 200. For securely fixing these connectors together, a coupling nut 120 is provided, which has an inner thread 122 interfacing with an outer thread 213 of the female outer conductor. Furthermore, the coupling nut 120 is coupled to the outer conductor of the connector 100 by means of a locking ring 130. It is further preferred, if there is a groove 112 or gap in the connector to allow for a movement of the coupling nut 120.

Figure 2:
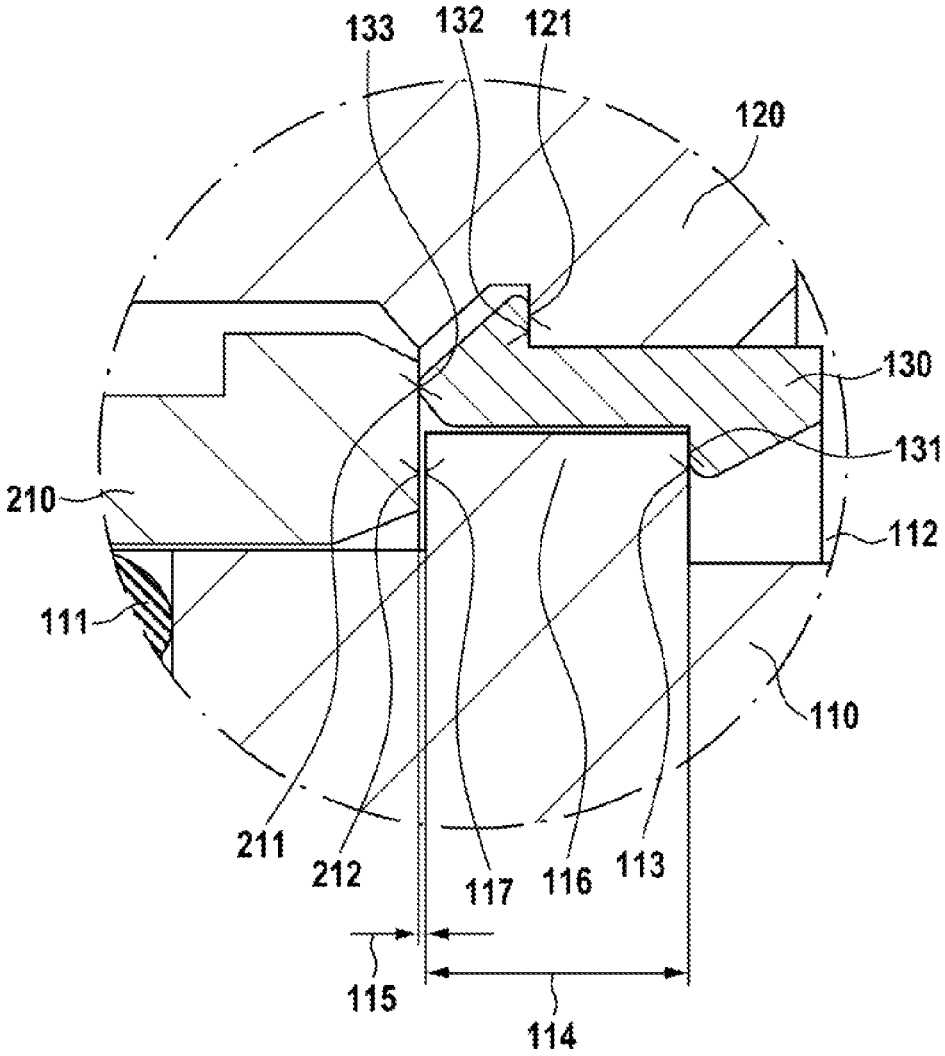
FIG. 2 shows the locking ring and its corresponding surfaces in detail.

In FIG. 2, the locking ring 130 and its corresponding surfaces are shown in detail. The locking ring 130 has a first edge, providing a first locking ring contact surface 131, which interfaces with a first protrusion contact surface 113. It furthermore has a second edge providing a second locking ring contact surface 132, which interfaces with a coupling nut contact surface 121. The first locking ring contact surface 131 and the second locking ring contact surface 132 face into opposite directions. Although they are shown under a right angle to the connector center axis, they may be slanted. Finally, the locking ring 130 has a third locking ring contact surface 133, which interfaces with a first mating connector contact surface 211 of the mating connector. When the coupling nut 120 is tightened, the coupling nut contact surface 121 presses against the second locking ring contact surface 132 of the locking ring 130, which itself presses by its third locking ring contact surface 133 against the first mating connector contact surface 211, and limits further movement of the coupling nut. In this state, the position of the locking ring 130 is fixed precisely defined in relationship to the mating connector, and most preferably against the mating connector's outer conductor 210. The first edge and its first locking ring contact surface 131 of locking ring 130 forms together with second mating connector contact surface 212 a gap which holds a protrusion 116 of the connector between the first protrusion contact surface 113 and the second protrusion surface 117. This gap has a width which is larger than the width 114 of the protrusion 116. This results in a gap 115, which allows for movement and specifically rotation of the connector against its mating connector.

Actually, this figure shows a pair of connectors (100, 200) in a mated state, when the third locking ring contact surface (133) contacts the first mating connector contact surface (211). Here, the first mating connector contact surface (211)

and the second mating connector contact surface (212) are in the same plane, although they may be in different planes.

Figure 3:
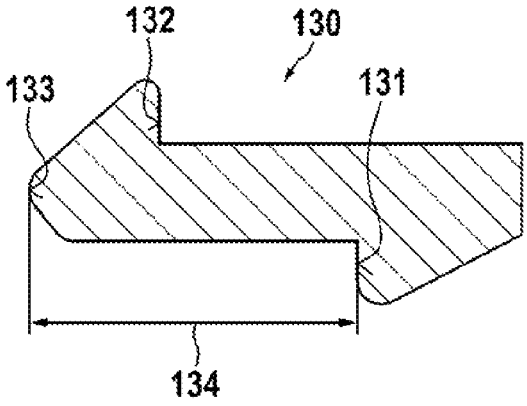
FIG. 3 shows a sectional view of the locking ring.

In FIG. 3, a sectional view of a locking ring 130 is shown. There is as previously described a first locking ring contact surface 131, a second locking ring contact surface 132 and a third locking ring contact surface 133. The locking distance 134 is defined by first locking ring contact surface 131 and the third locking ring contact surface 133.

Figure 4:
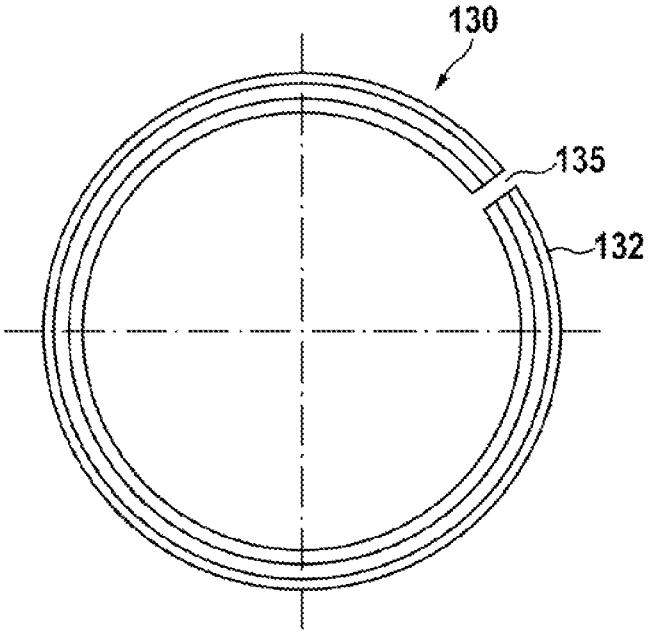
FIG. 4 shows a top view of the locking ring.

In FIG. 4, a top view of a locking ring 130 is shown. Here, the locking ring gap 135 can be seen. This gap allows for a compression of the locking ring to push the locking ring into the coupling nut.

It will be appreciated to those skilled in the art having the benefit of this disclosure that this invention is believed to provide RF connectors for coupling radio frequency signals. Further modifications and alternative embodiments of various aspects of the invention will be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims.

LIST OF REFERENCE NUMERALS

100 connector (male connector)
110 outer conductor
111 seal ring
112 groove
113 first protrusion contact surface
114 width of protrusion
115 gap
116 protrusion
117 second protrusion contact surface
119 center conductor
120 coupling nut
121 coupling nut contact surface
122 coupling nut inner thread
130 locking ring
131 first locking ring contact surface
132 second locking ring contact surface
133 third locking ring contact surface
134 locking distance
135 locking ring gap
200 mating connector (female connector)
210 mating connector outer conductor
211 first mating connector contact surface
212 second mating connector contact surface
213 mating connector outer thread

The invention claimed is:

1. RF connector comprising:
an RF connector including at least one protrusion with a first protrusion contact surface and a second protrusion contact surface, the second protrusion contact surface configured to interface to a mating connector;
a coupling nut configured to lock the RF connector to the mating connector; and
a locking ring that mechanically couples the coupling nut to the protrusion of the RF connector;
where the locking ring has a hollow cylinder-shaped body with an inner protrusion at the inner side of the cylinder and an outer protrusion at the outer side of the cylinder, where:
the inner protrusion includes a first locking ring contact surface interfacing to the first protrusion contact surface of the protrusion,
the outer protrusion includes a second locking ring contact surface interfacing to a coupling nut contact surface of the coupling nut,
the cylinder shaped body includes a third locking ring contact surface configured to interface to the mating connector.

2. RF connector according to claim 1, wherein
the first locking ring contact surface and the second locking ring contact surface are oriented in opposite directions.

3. RF connector according to claim 1, wherein
the first locking ring contact surface and the third locking ring contact surface are oriented in the same direction.

4. RF connector according to claim 1, wherein
the width of the at least one protrusion of the RF connector between the first protrusion contact surface and the second protrusion surface is less than the distance between the first locking ring contact surface and the third locking ring contact surface.

5. RF connector according to claim 1, wherein
the locking ring has a locking ring gap configured to allow compression of the locking ring to reduce its diameter.

6. RF connector according to claim 1, wherein
the RF connector is a plug connector.

7. RF connector pair comprising:
the RF connector according to claim 1; and
the mating connector including:
a first mating connector contact surface for interfacing with the third locking ring contact surface of the locking ring of the RF connector; and
a second mating connector contact surface for interfacing with the second protrusion contact surface of the RF connector.

8. RF connector pair according to claim 7, wherein
in a mated state, when the third locking ring contact surface of the RF connector contacts the first mating connector contact surface, the width of the at least one protrusion between the first protrusion contact surface and the second protrusion surface is less than the distance between the first locking ring contact surface of the RF connector and the second mating connector contact surface.

9. RF connector pair according to claim 7, wherein
the first mating connector contact surface and the second mating connector contact surface are in a same plane.

* * * * *